US006663364B2

(12) United States Patent
Okada et al.

(10) Patent No.: US 6,663,364 B2
(45) Date of Patent: Dec. 16, 2003

(54) SCROLL TYPE COMPRESSOR

(75) Inventors: Masahiko Okada, Kariya (JP); Takahiro Moroi, Kariya (JP); Yoshiyuki Nakane, Kariya (JP); Tsutomu Nasuda, Kariya (JP); Ryuta Kawaguchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/057,432

(22) Filed: Jan. 25, 2002

(65) Prior Publication Data

US 2002/0102173 A1 Aug. 1, 2002

(30) Foreign Application Priority Data

Jan. 26, 2001 (JP) ..... 2001-018617
Jul. 16, 2001 (JP) ..... 2001-215602

(51) Int. Cl.[7] ..... F01C 1/02
(52) U.S. Cl. ..... 418/55.1; 418/83
(58) Field of Search ..... 418/55.1, 83

(56) References Cited

U.S. PATENT DOCUMENTS 5,037,278 A * 8/1991 Fujio et al. ..... 418/83
2002/0039534 A1 * 4/2002 Moroi et al. ..... 417/372

FOREIGN PATENT DOCUMENTS

| | | | | |
|---|---|---|---|---|
| JP | 61-152991 | | 7/1986 | |
| JP | 61-182482 A | * | 8/1986 | ..... F04C/18/02 |
| JP | 08-247056 | | 9/1996 | |

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A scroll type compressor includes a housing, a fixed scroll member, a movable scroll member, a discharge port, a cooling chamber and a gas cooler. The fixed scroll member is fixed to the housing. The movable scroll member is accommodated in the housing and defining a compression region with the fixed scroll member where gas is compressed by orbiting the movable scroll member relative to the fixed scroll member. The compressed gas is discharged from the compression region through the discharge port. The cooling chamber for cooling the compressed gas is disposed in the vicinity of the compression region in the housing. The gas cooler for passing the gas discharged from the discharge port extends along the cooling chamber.

10 Claims, 11 Drawing Sheets

SCROLL TYPE COMPRESSOR

BACKGROUND OF THE INVENTION

The present invention relates to a scroll type compressor, more particularly to a scroll type compressor that compresses gas supplied to a fuel cell.

There are various types of compressors such as a screw type compressor, a rotary type compressor and a scroll type compressor. Since the scroll type compressor is small, light, and quiet without much vibration and noise, the scroll type compressor is widely used for freezing and air conditioning among others. The scroll type compressor produces heat in a compression cycle. In a prior art as described in Unexamined Japanese Patent Publication No. 8-247056, a cooling chamber is defined to the side which gas in a compression chamber is discharged in order to remove the heat.

FIG. 12 shows a cross-sectional view in an axial direction of a conventional scroll type compressor 100. In the compressor 100, a housing is constituted of a front casing 101, an end plate 102 and a rear casing 103. The end plate 102 is placed on one side of the front casing 101, to which gas is discharged. The rear casing 103 is placed on the other side of the front casing 101 where a motor which is not shown is connected. A discharge port 104 is formed at the center of the front casing 101. A discharge valve 108 which opens toward the end plate 102 side only is provided at the discharge port 104. A gas passage 112 is formed to penetrate the end plate 102 on the side of the discharge port 104, to which the gas is discharged. A cooling chamber 120 is defined between the front casing 101 and the end plate 102. A fixed scroll of a volute shape 105 extends from an inner wall 107 of the front casing 101 to face the side of the motor in a standing manner. On the other hand, a drive shaft 109, which is connected to a rotary shaft of the motor, is in the shape of crank. One end of the drive shaft 109 is rotatably supported by the rear casing 103 on the side of the motor. The other end of the drive shaft 109, to which the gas is discharged, is rotatably supported by an orbital plate 111. An orbital scroll of a volute shape 110 extends from the orbital plate 111 toward the front casing 101. The fixed scroll 105, the inner wall 107, the orbital scroll 110 and the orbital plate 111 cooperatively form compression chambers 106. The compression chambers 106 are defined in a volute shape.

Still referring to FIG. 12, when the drive shaft 109 is rotated by the motor, the orbital scroll 110 orbits. Gas such as air in the compression chambers 106 is moved toward the center of the fixed scroll 105 as is compressed by orbital movement of the orbital scroll 110. The temperature of the gas rises during the compression cycle. Then, the compressed gas is discharged outside the compressor 100 through the discharge port 104 and the gas passage 112.

Coolant such as cooling water flows into the cooling chamber 120 through an inlet which is not shown. The cooling chamber 120 is defined in the vicinity of the compression chambers 106 and the gas passage 112. Therefore, heat of the gas compressed in the compression chambers 106 and the gas discharged into the gas passage 112 is conducted to the coolant. The temperature of the coolant rises due to the heat conduction, and the coolant flows outside the compressor 100 through an outlet which is not shown.

In the above prior art, however, the gas is discharged outside the compressor 100 through the gas passage 112 which extends in the axial direction of the drive shaft 109. The gas passage 112 is short in length. Accordingly, when the discharge gas passes through the gas passage 112, heat exchange between the discharge gas and the coolant in the cooling chamber 120 is not sufficiently performed. Therefore, temperature of the discharge gas is not sufficiently decreased.

When the temperature of the discharge gas is high, if a device whose heat resistance is low is placed in the vicinity of the gas passage 112, the device may have trouble. For example, when the scroll type compressor 100 is used to compress the gas supplied to the fuel cell, a hydrogen ion exchange membrane is placed below the compressor 100. Since the hydrogen ion exchange membrane is low in heat resistance, the discharge gas in high temperature may cause trouble.

Since the discharge gas in high temperature is small in density, mass flow of the gas (kg/hour) decreases. Namely, compression efficiency is lowered. When the discharge gas is utilized, a predetermined mass of the gas per time unit may be required. In this case, if work of the compressor 100 is increased to reserve the predetermined mass of the gas, the compressor 100 or the motor driving the compressor 100 is required to be increased in size.

To decrease the temperature of the discharge gas without changing the work, another heat exchanger may be connected below the scroll type compressor 100. In this case, however, extra space for placing another heat exchanger is required.

SUMMARY OF THE INVENTION

The present invention addresses a scroll type compressor whose discharge gas is low in temperature.

According to the present invention, a scroll type compressor includes a housing, a fixed scroll member, a movable scroll member, a discharge port, a cooling chamber and a gas cooler. The fixed scroll member is fixed to the housing. The movable scroll member is accommodated in the housing and defining a compression region with the fixed scroll member where gas is compressed by orbiting the movable scroll member relative to the fixed scroll member. The compressed gas is discharged from the compression region through the discharge port. The cooling chamber for cooling the compressed gas is disposed in the vicinity of the compression region in the housing. The gas cooler for passing the gas discharged from the discharge port extends along the cooling chamber.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A scroll type compressor according to a first preferred embodiment of the present invention will be described with reference to FIGS. 1 through 3. As a matter of convenience, a discharge direction and a motor direction are referred to as 'front' and 'rear' respectively.

Figure 1:
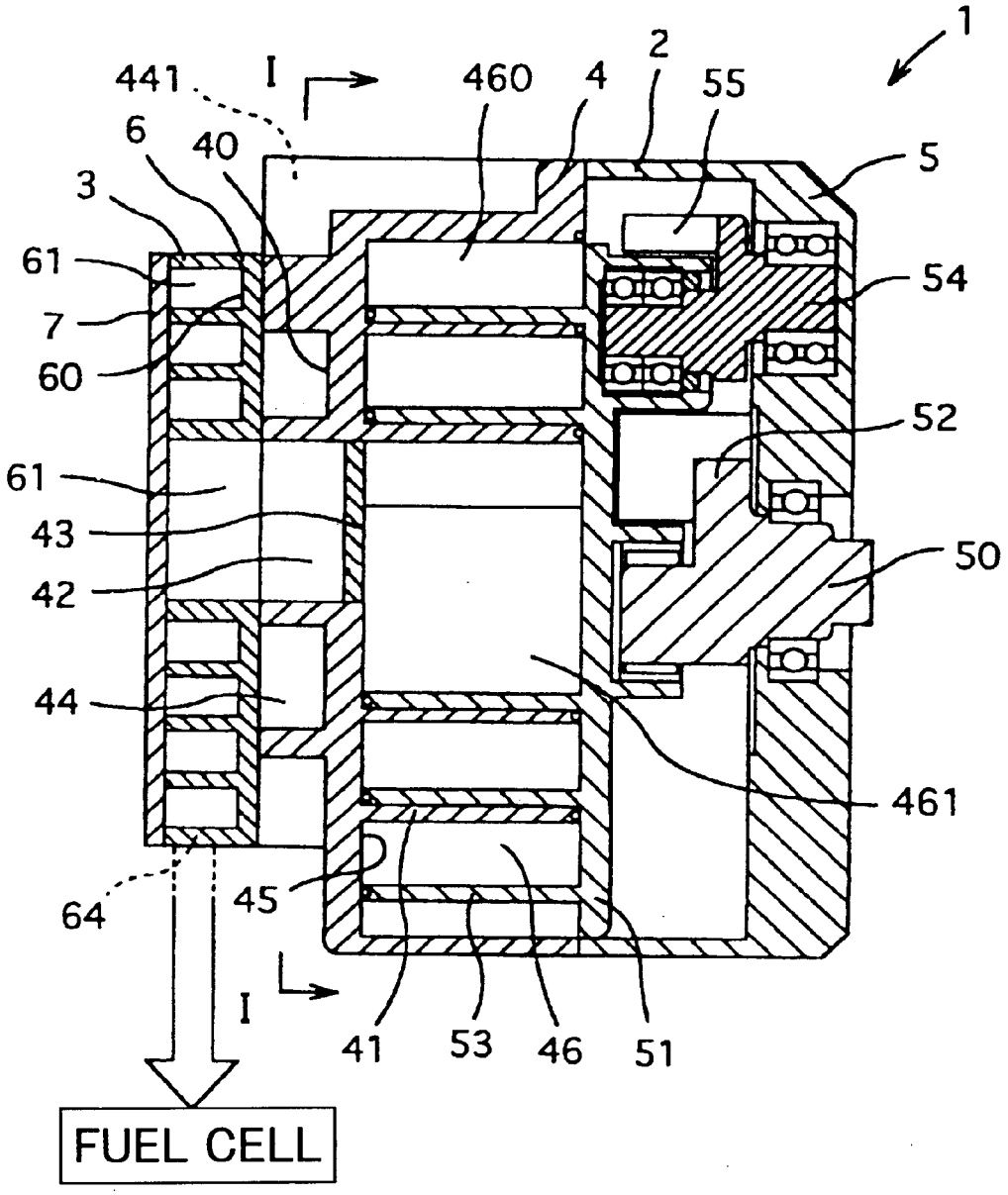
FIG. 1 is a diagram in a cross-sectional view in an axial direction illustrating the scroll type compressor of the first preferred embodiment according to the present invention.

As shown in FIG. 1, a scroll type compressor 1 is used to compress air supplied to a fuel cell as oxidizing agent. The scroll type compressor 1 is driven by a motor which is not shown. In the first preferred embodiment, the hull of the scroll type compressor 1 is constituted of a housing 2 and a gas cooler 3 placed in front of the housing 2.

Still referring to FIG. 1, the housing 2 is constituted of a front casing 4 and a rear casing 5. A recess 40 is formed in the front surface of the front casing 4. The rear casing 5 is placed in the rear of the front casing 4. Note that these members are made of aluminum alloy.

A fixed scroll of a volute shape 41 is provided on an inner wall 45 of the front casing 4 so as to extend rearward. A discharge port 42 is formed at the center of volute of the fixed scroll 41, and a discharge valve 43 that opens only in the discharge direction is provided at the discharge port 42. Further, a cooling chamber 44 is defined between the recess 40 of the front casing 4 and the gas cooler 3.

Figure 2:
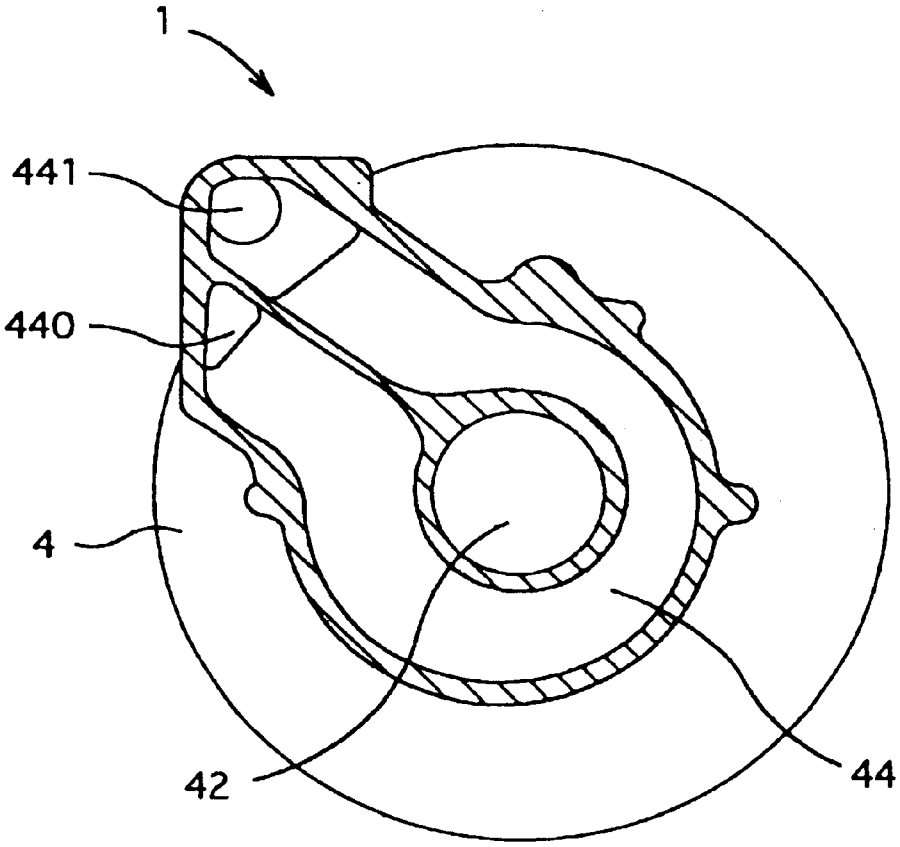
FIG. 2 is a diagram in a cross-sectional view at a line I—I in FIG. 1.

As shown in FIG. 2, the cooling chamber 44 is formed in the letter U shape surrounding the discharge port 42. A first inlet 440, which cooling water flows in, is formed at one end of the cooling chamber 44, and a first outlet 441, from which the cooling water flows out, is formed at the other end. Note that the cooling chamber 44 constitutes a part of a cooling circuit. A radiator which is not shown, for cooling high temperature cooling water flowed out from the first outlet 441, a pump which is not shown, for flowing the cooling water that has been cooled through the first inlet 440, and the like are placed in the cooling circuit. Pure water generated due to cell reaction in the fuel cell is used as the cooling water that circulates the cooling circuit.

On the other hand, as shown in FIG. 1, one end of a drive shaft 50 is rotatably supported in the rear end of the rear casing 5 through ball bearings. The drive shaft 50 is in a crank shape. The other end of the drive shaft 50 is rotatably supported in an orbital plate 51 in a disc shape through bearings. A balance weight 52 for balancing during rotation of the drive shaft 50 is also formed on the other end of the drive shaft 50. An orbital scroll of a volute shape 53 extends from the orbital plate 51 in the discharge direction. Note that the rear end of the drive shaft 50 is connected with a motor rotation shaft which is not shown. Further, the end of the fixed scroll 41 extending from the inner wall 45 of the front casing 4 contacts the surface of the orbital plate 51. On the other hand, the end of the orbital scroll 53 contacts the inner wall 45 of the front casing 4. In other words, the fixed scroll 41 and the orbital scroll 53 are engaged between the inner wall 45 and the orbital plate 51 so as to overlie alternately with each other at a position where the scrolls are relatively rotated by 180° degrees. The inner wall 45, the fixed scroll 41, the orbital plate 51 and the orbital scroll 53 define compression chambers 46 as a compression region. In addition, a part of the front end of an axis 54 for preventing rotation is rotatably supported in an outer circumferential side of the orbital plate 51 through ball bearings. The axis 54 is also in a crank shape with a divided front end similarly to the drive shaft 50. A balance weight 55 is formed on a part of the divided front end. Furthermore, the rear end of the axis 54 is rotatably supported in the rear casing 5 through ball bearings.

Still referring to FIG. 1, the gas cooler 3 is constituted of a first casing 6 formed in front of the front casing 4 and an end plate 7 placed on the front end of the first casing 6. Note that these members are made of aluminum alloy.

Figure 3:
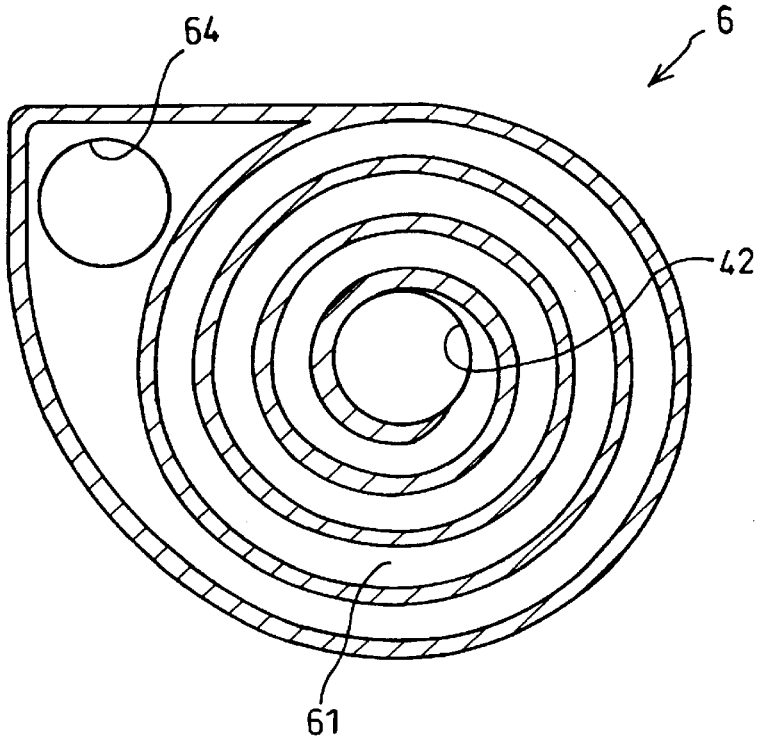
FIG. 3 is a diagram in a front view illustrating a casing for gas cooler of the scroll type compressor of the first preferred embodiment according to the present invention.

As shown in FIG. 3, the first casing 6 is in a dish shape that opens forward. A first spiral groove 60 of a spiral shape is continuously formed inside the first casing 6. A first gas passage 61 is formed between the first spiral groove 60 and the end plate 7. The first gas passage 61 is arranged in a spiral shape between the discharge port 42 at the center and a discharge port 64 of an outermost gas passage (hereinafter referred to as a discharge passage port 64).

As shown in FIG. 1, when the motor which is not shown rotates the drive shaft 50, its rotation force is transmitted to the orbital plate 51 to allow the orbital plate 51 to orbit about the drive shaft 50. Then, the orbital scroll 53 performs an orbital motion along the fixed scroll 41. Note that the rotation of the orbital scroll 53 is prevented by the axis 54.

Still referring to FIG. 1, when the orbital scroll 53 starts the orbital motion, air is taken in from an air intake port which is not shown, to be flowed into outermost compression chambers 460 of the compression chambers 46 connected with the air intake port. The air in the compression chambers 46 moves spirally toward a center 461 of volute of the fixed scroll 41. Air compression is performed in this process. Compressed air reaches the center 461 of the volute to be flowed into the first gas passage 61 pushing away the discharge valve 43. The air moves spirally in the first gas passage 61 in an outermost direction and is supplied to the fuel cell through the discharge passage port 64.

The cooling water flows into the cooling chamber 44 from the first inlet 440 and absorbs heat of the air being compressed in the compression chamber 46 and discharge air in the first gas passage 61, and flows out from the first outlet 441. The cooling water flowed out from the first outlet 441 is cooled by the radiator and is flowed into the cooling chamber 44 again by the pump. Specifically, the cooling water circulates within the cooling circuit while repeating increase and decrease in temperature. However, a part of the cooling water flowed from the first outlet 441 is discarded, and the pure water generated in the fuel cell is appropriately refilled into the cooling circuit by the discarded amount.

Note that the gas cooler 3 of this embodiment is fabricated in a process that the first casing 6 forming the first spiral groove 60 is cast in advance and the end plate 7 is then screwed by a bolt from the above. Note that a rubber member which is not shown, is located between the first casing 6 and the end plate 7 to secure airtightness of the first gas passage 61.

A scroll type compressor according to a second preferred embodiment of the present invention will be described with reference to FIG. 4. The scroll type compressor 1 of this embodiment is one where first dividing fins 65 for dividing the gas flow in parallel are provided in the first gas passage 61 in a standing manner. Other configuration and manufacturing method are the same as the first embodiment. Note that the same reference numerals are used for the members corresponding to those of the first embodiment.

Figure 4:
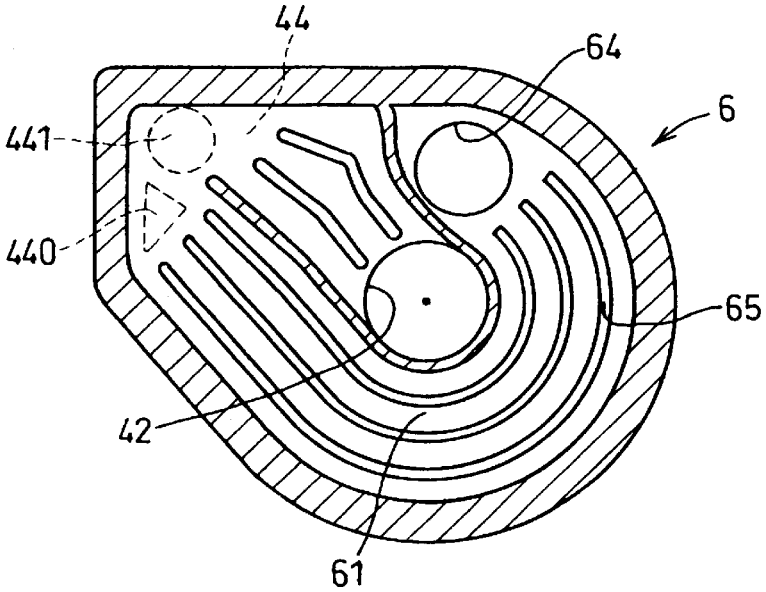
FIG. 4 is a diagram in a front view illustrating a casing for gas cooler of the scroll type compressor of the second preferred embodiment according to the present invention.

Still referring to FIG. 4, the first dividing fins 65 for dividing gas passage extending along the first gas passage 61 are provided in a standing manner between the discharge port 42 at the center and the discharge passage port 64. The first dividing fins 65 divide the gas flow discharged from the discharge port 42. Furthermore, the first gas passage 61 of this embodiment is arranged in a wide area so as to contact an entire front surface of the cooling chamber 44 which is shown in a dotted line arranged in the rear side. With the first dividing fins 65 provided in a standing manner and with an increased contact area with the cooling chamber 44, the heat conducting area of the first gas passage 61 increases. Thus, the cooling efficiency of the first gas passage 61 of this embodiment is improved.

A scroll type compressor according to a third preferred embodiment of the present invention will be described with reference to FIG. 5. The scroll type compressor 1 of this embodiment is one where the dividing fins 65 for dividing the gas flow in two ways are provided in the first gas passage 61 in a standing manner. Other configuration and manufacturing method are the same as the first embodiment. Note that the same reference numerals are used for the members corresponding to those of the first embodiment.

Figure 5:
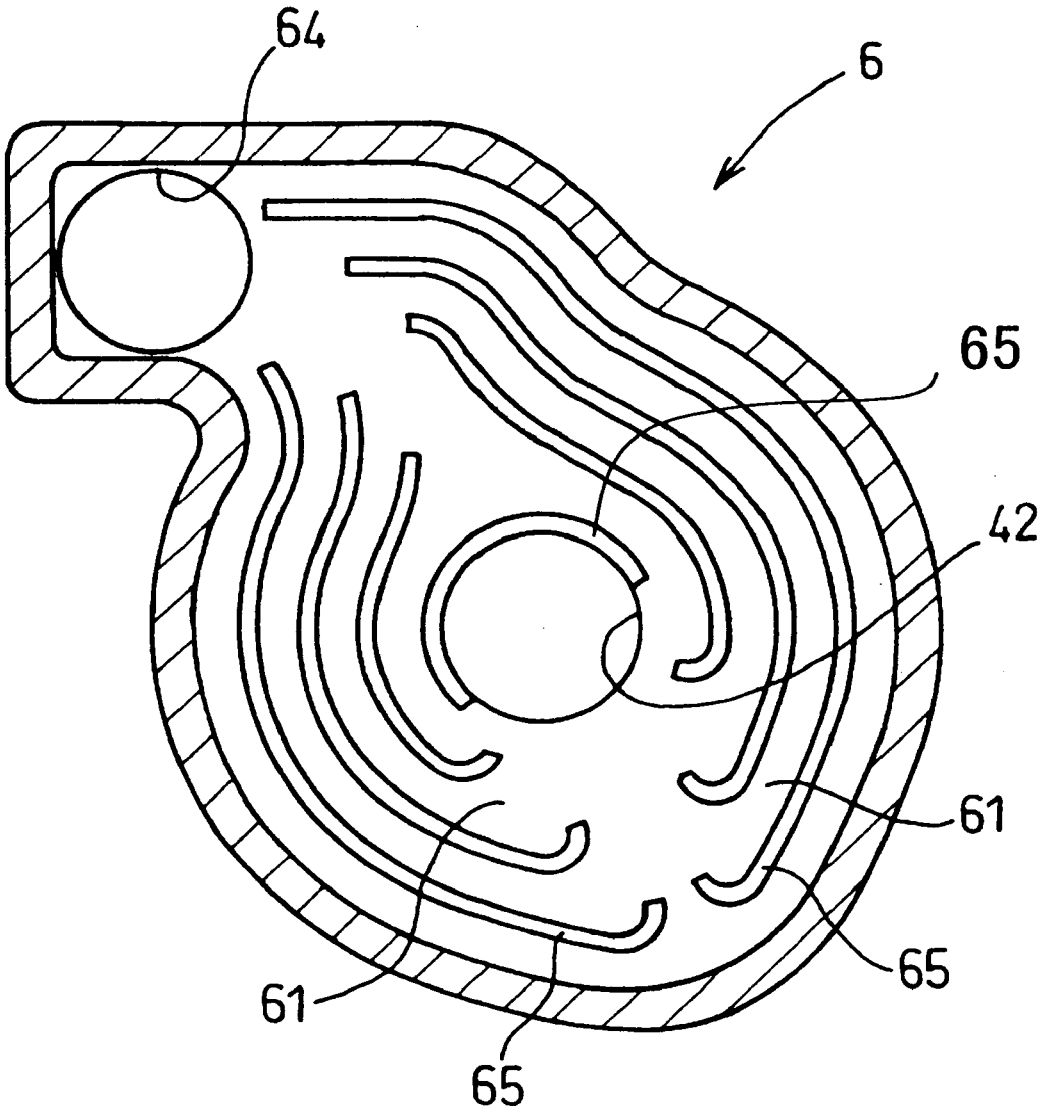
FIG. 5 is a diagram in a front view illustrating a casing for gas cooler of the scroll type compressor of the third preferred embodiment according to the present invention.

Still referring to FIG. 5, the first dividing fins 65 are arranged between the discharge port 42 at the center and the discharge passage port 64. The first dividing fins 65 define the area from the discharge port 42 to the discharge passage port 64 in eight courses in total having four courses anti-clockwise and four courses clockwise. When the gas flow is divided in two ways, the gas flow path from the discharge port 42 to the discharge passage port 64 becomes short in length. Accordingly, the pressure loss becomes smaller than the case where, for example, the fins are provided spirally without dividing the gas flow.

A scroll type compressor according to a fourth preferred embodiment of the present invention will be described with reference to FIG. 6. The scroll type compressor 1 of this embodiment is one where the dividing fins 65 for radially dividing the gas flow are provided in the first gas passage 61 in a standing manner. Other configuration and manufacturing method are the same as the first embodiment. Note that the same reference numerals are used for the members corresponding to those of the first embodiment.

Figure 6:
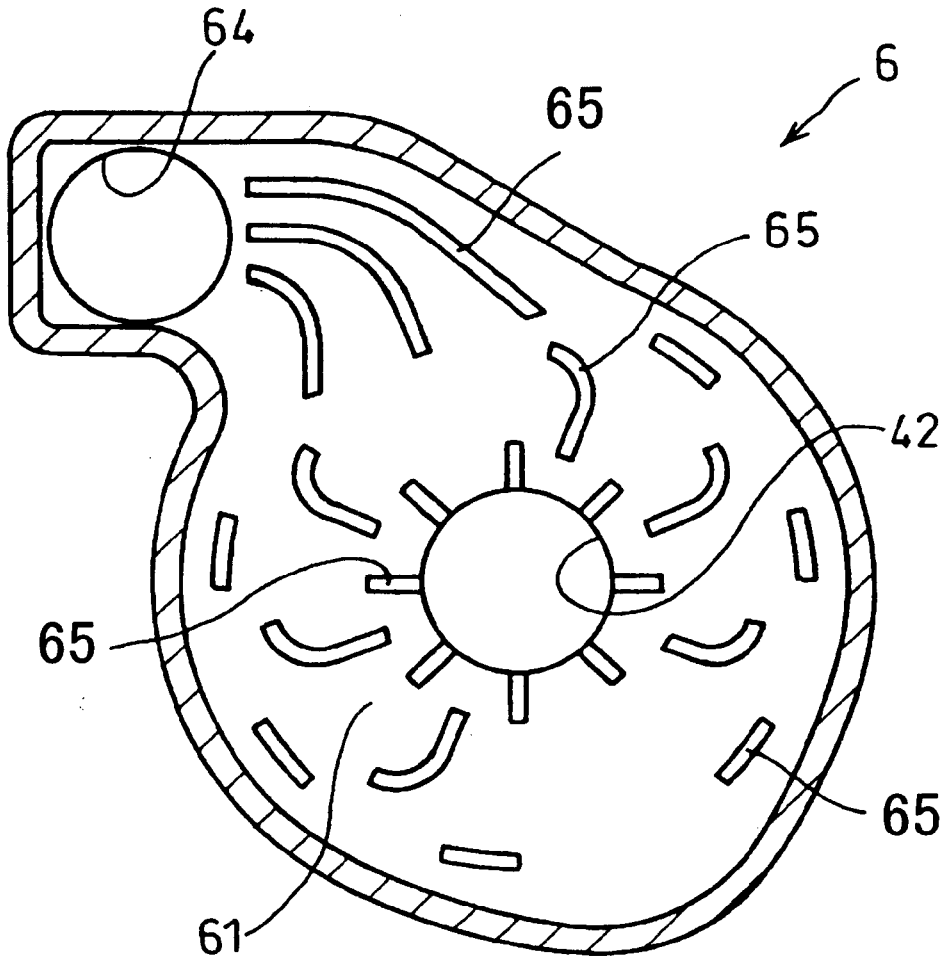
FIG. 6 is a diagram in a front view illustrating a casing for gas cooler of the scroll type compressor of the fourth preferred embodiment according to the present invention.

Still referring to FIG. 6, the first dividing fins 65 are arranged in a scattering manner between the discharge port 42 at the center and the discharge passage port 64. The first dividing fins 65 radially divide the discharge gas discharged from the discharge port 42. Accordingly, in the first gas passage 61 of this embodiment, the pressure loss becomes even smaller.

A scroll type compressor according to a fifth preferred embodiment of the present invention will be described with reference to FIG. 7. The scroll type compressor 1 of this embodiment is one where bars 67 for generating turbulence in the gas flow are arranged in the first gas passage 61. Other configuration and manufacturing method are the same as the first embodiment. Note that the same reference numerals are used for the members corresponding to those of the first embodiment.

Figure 7:
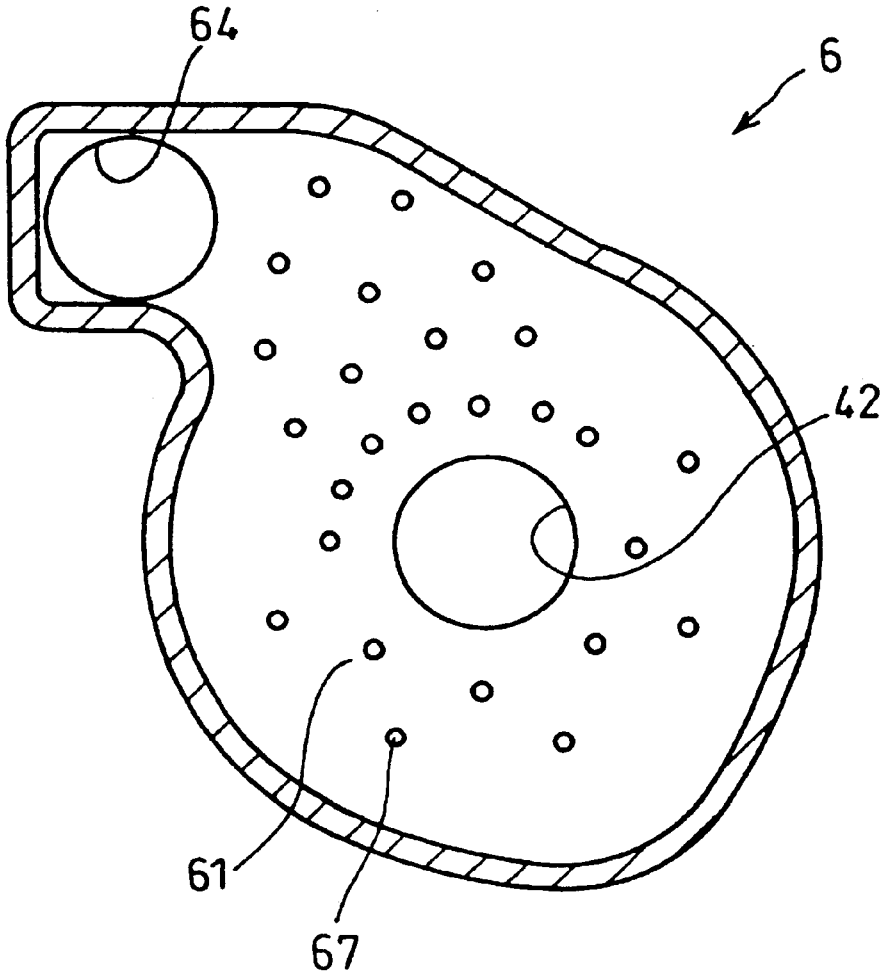
FIG. 7 is a diagram in a front view illustrating a casing for gas cooler of the scroll type compressor of the fifth preferred embodiment according to the present invention.

Still referring to FIG. 7, the bars 67 for generating turbulence in the gas flow are arranged in a scattering manner between the discharge port 42 at the center and the discharge passage port 64. The bars 67 causes turbulence in the gas discharged from the discharge port 42. When the turbulence is generated, the residence time of the discharge gas in the first gas passage 61 becomes long accordingly. Specifically, the cooling time of the discharge gas becomes long accordingly. Therefore, the cooling efficiency is improved according to this embodiment.

A scroll type compressor according to a sixth preferred embodiment of the present invention will be described with reference to FIG. 8. The scroll type compressor 1 of this embodiment is one where cooling fins 62 are provided in the first gas passage 61. Note that the same reference numerals are used for the members corresponding to those of the first embodiment.

Figure 8:
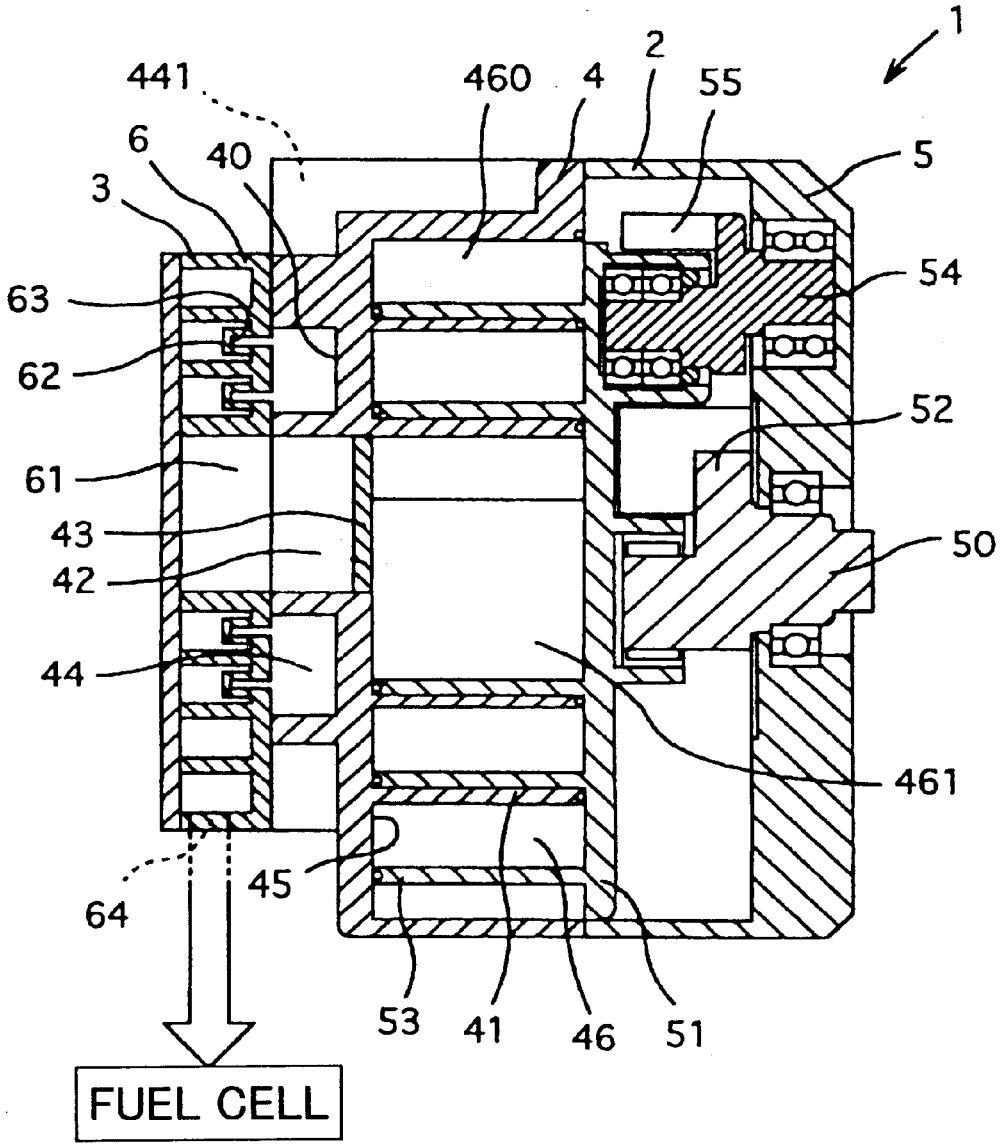
FIG. 8 is a diagram in a cross-sectional view in an axial direction illustrating the scroll type compressor of the sixth preferred embodiment according to the present invention.

Still referring to FIG. 8, in the scroll type compressor 1 of this embodiment, the cooling fins 62 are provided in a standing manner in the first gas passage 61. Further, the inside of the cooling fins 62 is a part of the cooling chamber 44, in which the cooling water circulates. In other words, grooves 63 are formed on rear sides of the cooling fins 62, and the cooling chamber 44 is defined between the grooves 63 and the recess 40 of the front casing 4.

The gas cooler 3 of this embodiment is fabricated in a process that the first casing 6 provided with the cooling fins 62 is cast in advance and the end plate 7 is then screwed by the bolt from the above. The configuration of the other part is the same as the first embodiment.

A scroll type compressor according to a seventh preferred embodiment of the present invention will be described with reference to FIG. 9. The scroll type compressor 1 of this embodiment is one where the gas cooler 3 is integrally formed with the housing 2. Specifically, the first gas passage 61 and the cooling passage 47 are arranged in the housing 2 in a dual spiral shape. Note that the same reference numerals are used for the members corresponding to those of the first embodiment.

Figure 9:
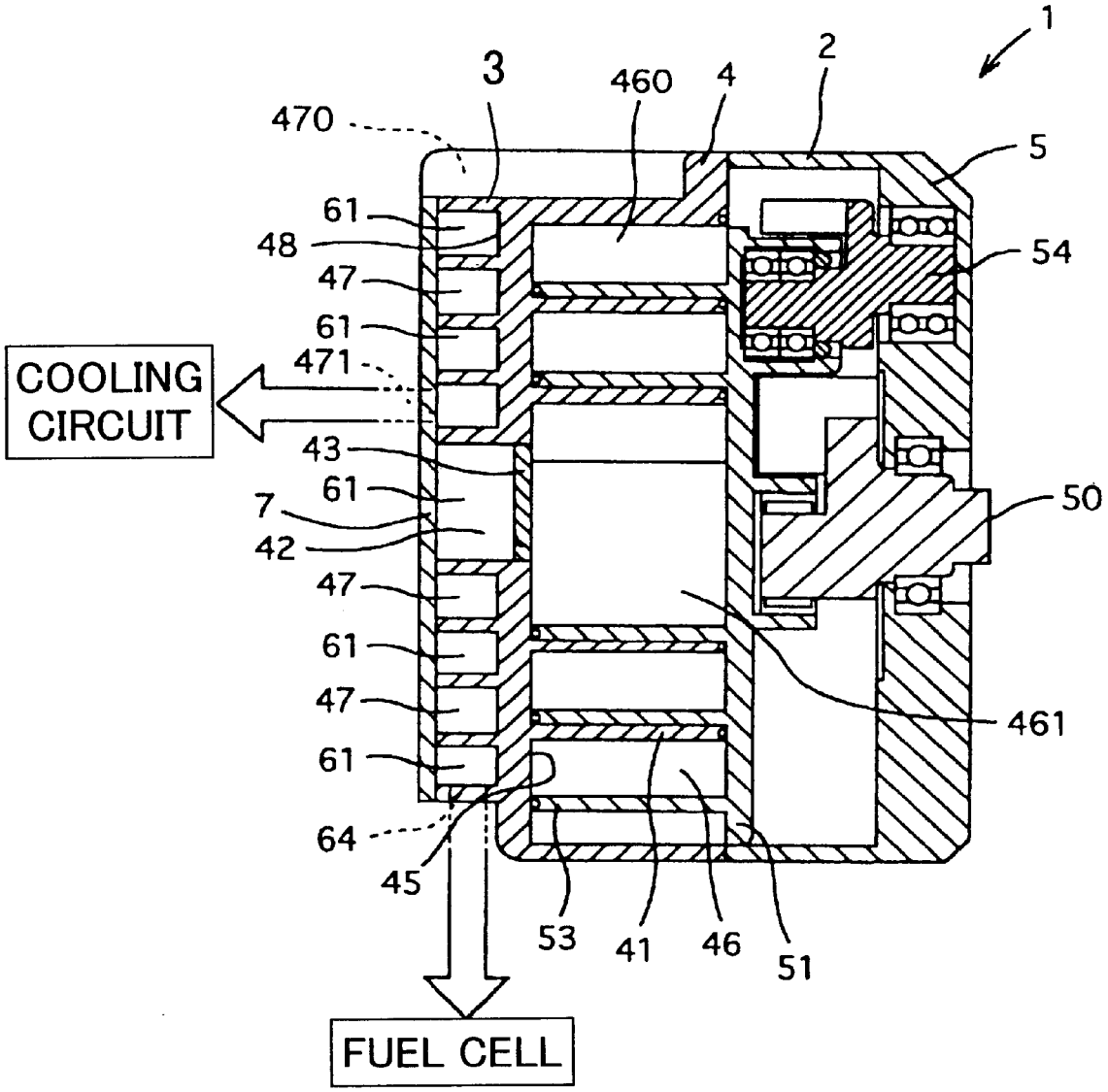
FIG. 9 is a diagram in a cross-sectional view in an axial direction illustrating the scroll type compressor of the seventh preferred embodiment according to the present invention.

Still referring to FIG. 9, the housing 2 of the scroll type compressor 1 of this embodiment is constituted of the front casing 4 where a dual spiral groove 48 is formed in the front surface, the end plate 7 placed in front of the front casing 4 while covering the dual spiral groove 48, and the rear casing 5 placed in the rear of the front casing 4.

In the scroll type compressor 1 of this embodiment, dual spiral passages are formed between the end plate 7 and the dual spiral groove 48 in a perpendicular direction to the axial direction. One of the passages is the first gas passage 61, and the other one is the cooling passage 47. The cooling water flows into the cooling passage 47 from a second inlet 470 provided in the outermost area of the front casing 4 and, moves spirally in an innermost direction, and flows out from a second outlet 471. On the other hand, the discharge gas flows into the first gas passage 61 from the discharge port 42, moves spirally in the outermost direction which is an opposite direction to the cooling water, is discharged outside the compressor 1 from the discharge passage port 64, and is supplied to the fuel cell.

In this embodiment, the first gas passage 61 and the cooling passage 47 are fabricated in a process where the front casing 4 provided with the dual spiral groove 48 is cast in advance and the end plate 7 is then screwed by the bolt from the above. Note that the rubber member is located between the front casing 4 and the end plate 7 to secure airtightness of the first gas passage 61 and liquid-tightness of the cooling passage 47. The configuration of the other part is the same as the first embodiment.

A scroll type compressor according to a eighth preferred embodiment of the present invention will be described with reference to FIG. 10. The scroll type compressor 1 of this embodiment is one where an auxiliary cooling chamber 81 is further provided in front of a second gas passage 91. Note that the same reference numerals are used for the members corresponding to those of the first embodiment.

Figure 10:
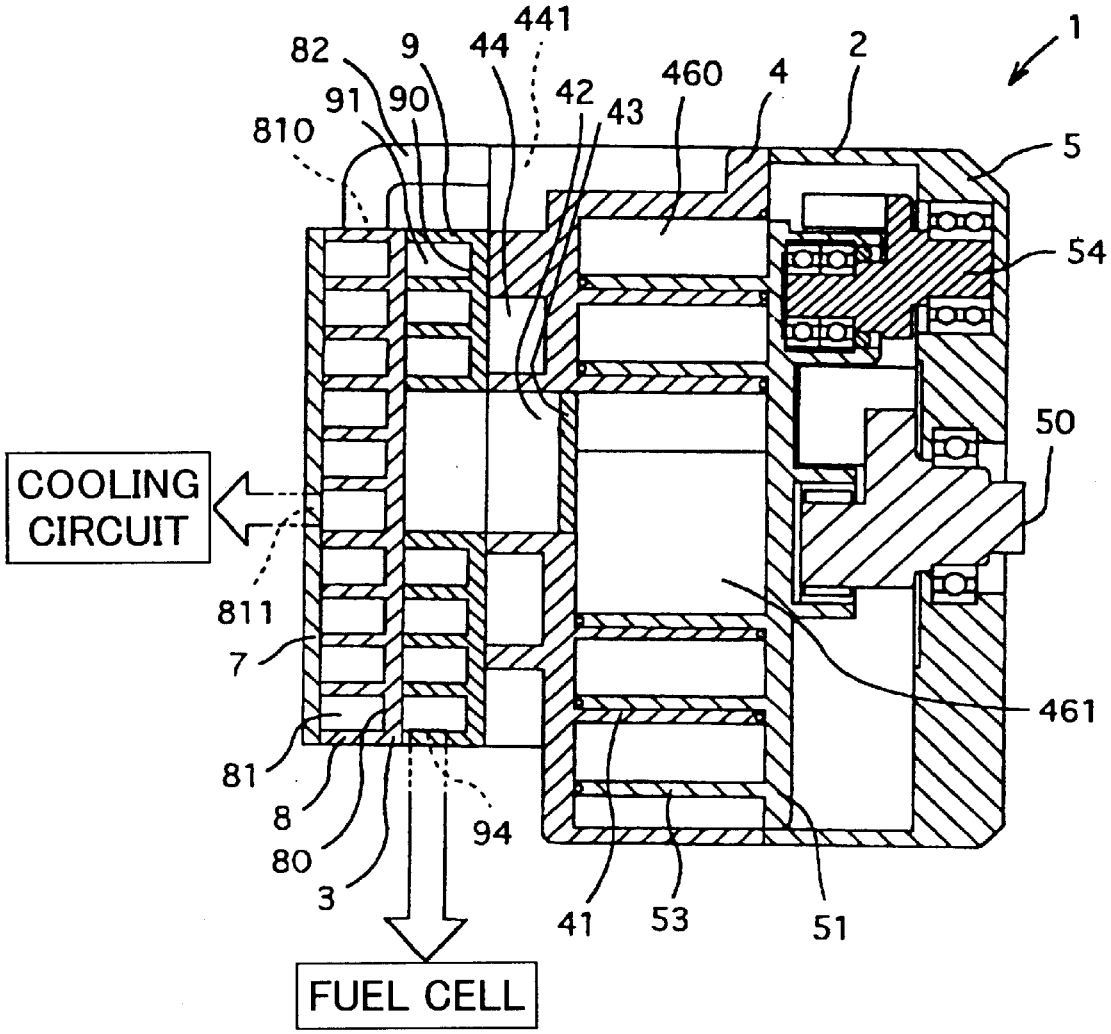
FIG. 10 is a diagram in a cross-sectional view in an axial direction illustrating the scroll type compressor of the eighth preferred embodiment according to the present invention.

Still referring to FIG. 10, the gas cooler 3 of the scroll type compressor 1 of this embodiment is constituted of a second casing 9 placed in front of the front casing 4, a third casing 8 placed in front of the second casing 9, and the end plate 7 placed in front of the third casing 8. The second casing 9 is for gas passage. The third casing 8 is for cooling chamber.

The second casing 9 is in a dish shape that opens forward. Second spiral grooves 90 are formed in the second casing 9. The second gas passage 91 is formed between the second spiral grooves 90 and the third casing 8. The third casing 8 is also in a dish shape that opens forward. Third spiral grooves 80 are formed in the third casing 8 as well. The auxiliary cooling chamber 81 is formed between the third spiral grooves 80 and the end plate 7. Furthermore, the first outlet 441 of the cooling chamber 44 and a third inlet 810 of the auxiliary cooling chamber 81 are connected by a connecting pipe 82. The discharge gas flows into the second gas passage 91 from the discharge port 42, moves spirally in the outermost direction, is discharged outside the compressor 1 from a second discharge port 94 of the outer most gas passage, and is supplied to the fuel cell. On the other hand, the cooling water flows into the auxiliary cooling chamber 81 from the cooling chamber 44 through the third inlet 810, moves spirally in the innermost direction, and flows outside the compressor 1 from a third outlet 811.

The gas cooler 3 of this embodiment is fabricated in a process that the second casing 9 and the third casing 8 are cast first, the third casing 8 is screwed in front of the second casing 9 by the bolt, and the end plate 7 is then screwed by the bolt in front of the third casing 8. Note that the rubber members are located between the second casing 9 and the third casing 8 and between the third casing 8 and the end plate 7 respectively to secure airtightness of the second gas passage 91 and liquid-tightness of the auxiliary cooling chamber 81. The configuration of the other part is the same as the first embodiment.

A scroll type compressor according to a ninth preferred embodiment of the present invention will be described with reference to FIG. 11. The scroll type compressor 1 of this embodiment is one where the auxiliary cooling chamber 81 is provided in front of the second gas passage 91 similarly to the eighth preferred embodiment. At the same time, the compressor 1 is one where the auxiliary cooling fins 93 extending from the front area of the second gas passage 91 toward the auxiliary cooling chamber 81 and the cooling fins 95 extending from the rear surface of the second gas passage 91 toward the cooling chamber 44 are arranged. Note that the same reference numerals are used for the members corresponding to those of the eighth embodiment.

Figure 11:
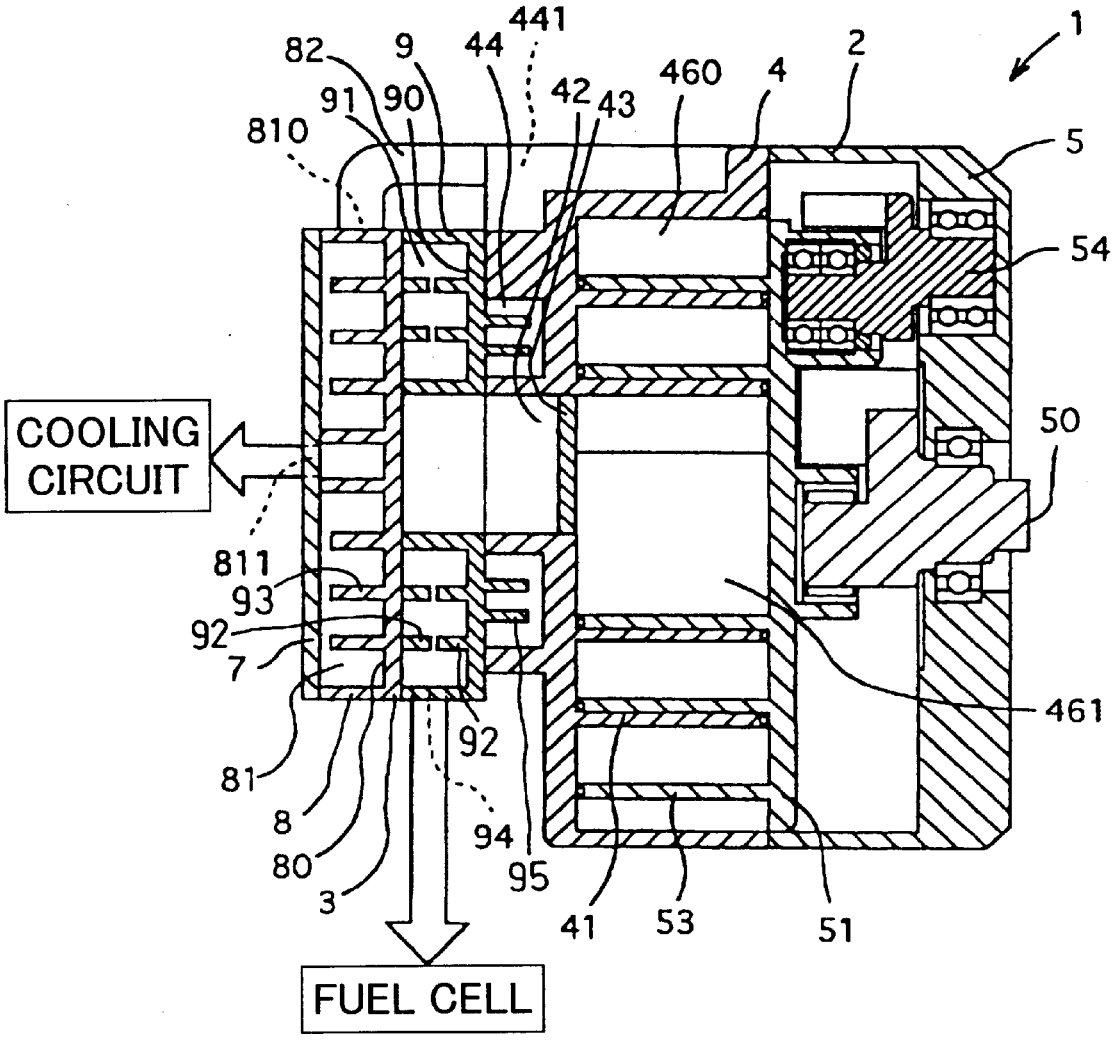
FIG. 11 is a diagram in a cross-sectional view in an axial direction illustrating the scroll type compressor of the ninth preferred embodiment according to the present invention.
Figure 12:
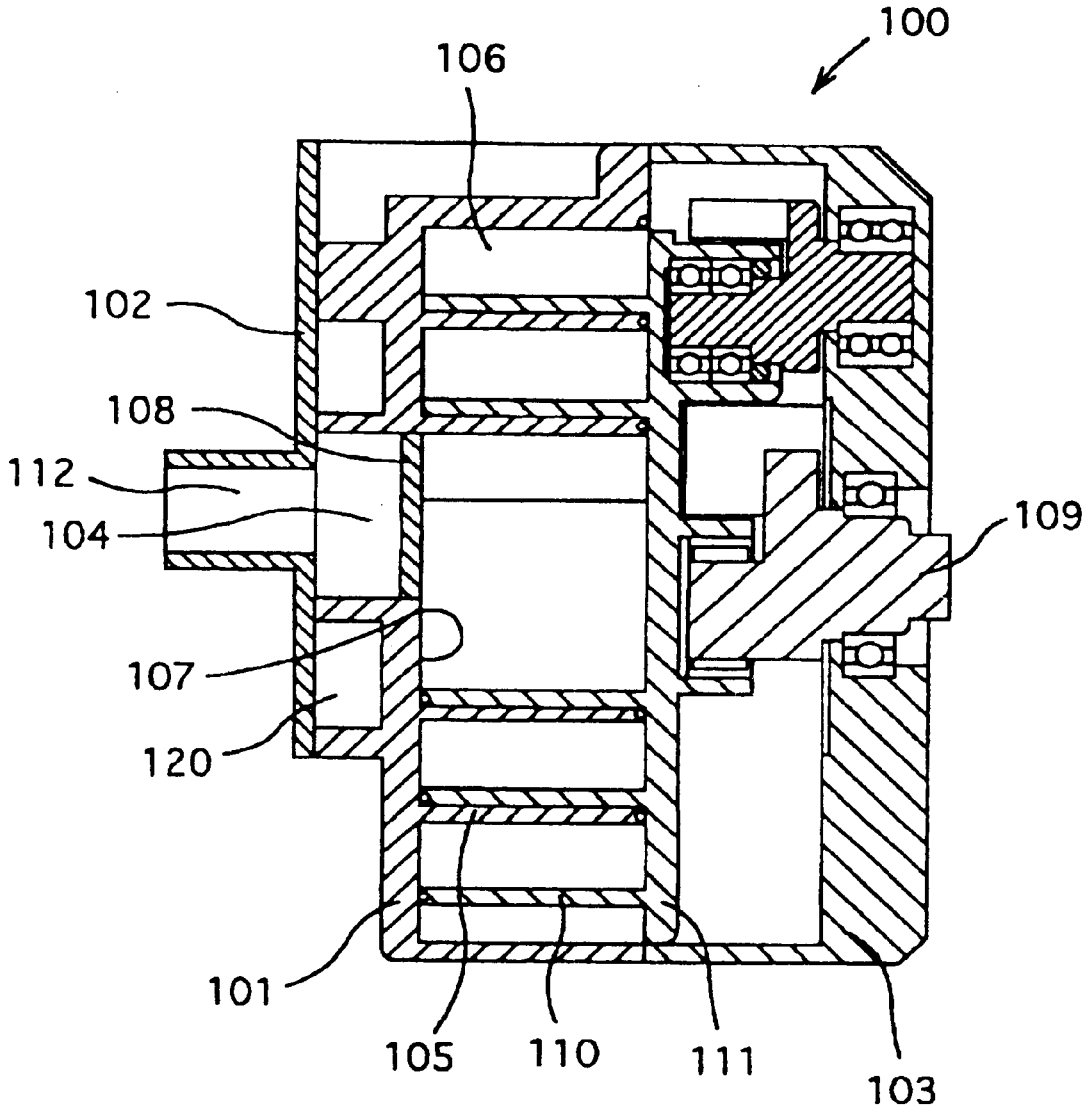
Fig. 12 (Prior Art)
FIG. 12 is a diagram in a cross-sectional view in an axial direction illustrating a conventional scroll type compressor.

Still referring to FIG. 11, the gas cooler 3 of the scroll type compressor 1 of this embodiment is constituted of the second casing 9 placed in front of the front casing 4, the third casing 8 placed in front of the second casing 9, and the end plate 7 placed at the front end of the third casing 8.

The second casing 9 is in a dish shape that opens forward. Second dividing fins 92 for dividing the second gas passage 91, which extend forward and cooling fins 95 for dividing the cooling chamber 44, which extend backward are severally provided on the bottom wall of the second casing 9 in a standing manner. The third casing 8 is also in a dish shape that opens forward. The auxiliary cooling fins 93 extending forward and the second dividing fins 92 extending backward are severally provided on the bottom wall of the third casing 8 in a standing manner.

Then, the second gas passage 91 is defined in courses by the second dividing fins 92 that extend from the front and the rear. The cooling chamber 44 is also defined in courses by the cooling fins 95 that extend from the front. Furthermore, the auxiliary cooling chamber 81 is defined in courses by the auxiliary cooling fins 93 that extend from the rear. The configuration of the other part and the manufacturing method is the same as the eighth embodiment.

The discharge gas flows into the second gas passage 91 from the discharge port 42. Then the discharge gas spirally moves in the second gas passage 91 widening its diameter to the second discharge port 94 while being divided in parallel by the second dividing fins 92. Then, the discharge gas is discharged outside the compressor 1 from the second discharge port 94 and is supplied to the fuel cell. On the other hand, the cooling water flows into the auxiliary cooling chamber 81 through the third inlet 810 after moving through the cooling chamber 44 while being divided in parallel by the cooling fins 95. Then, the cooling water spirally moves reducing its diameter in the auxiliary cooling chamber 81 while being divided in parallel by the auxiliary cooling fins 93. Thereafter, the cooling water flows outside the compressor 1 from the third outlet 811.

The second dividing fins 92 are arranged in the compressor 1 of this embodiment. The cooling fins 95 and the auxiliary cooling fins 93 are also arranged. For this reason, the heat conducting area between the second gas passage 91 and the cooling chamber 44 and between the second gas passage 91 and the auxiliary cooling chamber 81 are increased. Therefore, the cooling efficiency of the discharge gas is further improved.

Note that the auxiliary cooling chamber 81 is arranged and the auxiliary cooling fins 93 are inserted therein in this embodiment. However, the compressor 1 may be embodied in a mode where the auxiliary cooling chamber 81 is not arranged. Specifically, the auxiliary cooling fins 93 may be provided in a standing manner at the front end of the compressor 1 in an open state. The cooling efficiency of the discharge gas is improved in this mode as well because the heat conducting area to the atmosphere is increased.

The scroll type compressor of the present invention is particularly suitable for compressing gas supplied to a fuel cell. In the automobile industry, expectation for an electric vehicle having the fuel cell as a drive source has been rising. A small and lightweight scroll type compressor is drawing attention as a compressor of the gas supplied to the fuel cell.

In the fuel cell, the gas of a desired mass flow needs to be supplied in accordance with an amount of electric power generation. According to the scroll type compressor of the present invention, since the temperature of the gas supplied to the fuel cell is low, the mass flow of the gas is large.

Therefore, the gas of a desired mass flow can be easily supplied to the fuel cell.

Further, when the gas is supplied to the fuel cell, the gas needs to be humidified in advance before cell reaction. For this purpose, a hydrogen ion exchange membrane is provided at the exit of the discharge port of the compressor as described above, whose heat-resistant temperature is about 140° C. There exists a part having the heat-resistant temperature of about 100° C. among parts constituting the fuel cell. Therefore, the gas needs to be cooled by the compressor in advance to a level that can fulfill the temperature conditions. According to the scroll type compressor of the present invention, the gas supplied to the fuel cell can be cooled to the level that fulfills the foregoing conditions, and the fuel cell and its attached equipment can be protected from heat.

Moreover, pure water is generated as a by-product of the cell reaction in the fuel cell, and the pure water can be effectively used as coolant supplied to the cooling chamber.

Note that the gas supplied to the fuel cell is air and oxygen as an oxidizing agent, and hydrogen as fuel. Any type of the gas can be compressed by the scroll type compressor of the present invention.

In the embodiments, the present invention is applied to the scroll type compressor. However, the present invention may be applied to other type of compressors.

According to the present invention, a scroll type compressor whose discharge gas is low in temperature is offered.

In the foregoing, modes of embodiment of the scroll type compressor of the present invention have been described, but the embodiment is not particularly limited to the foregoing one. The present invention may be embodied in various changes and improvement that can be performed by those skilled in the art.

What is claimed is:

1. A scroll type compressor comprising:

a housing;

a fixed scroll member fixed to the housing;

a movable scroll member accommodated in the housing and defining a compression region with the fixed scroll member, gas being compressed in the compression region by orbiting the movable scroll member relative to the fixed scroll member;

a discharge port for discharging the compressed gas from the compression region;

a cooling chamber for cooling the compressed gas, disposed in the vicinity of the compression region in the housing, the cooling chamber being a tubular cooling passage; and a gas cooler for passing the gas discharged from the discharge port, extending along the cooling chamber, wherein the cooling passage and the gas cooler are placed one after the other in an axial direction.

2. The scroll type compressor according to claim 1 wherein the discharge port is surrounded by the cooling chamber.

3. The scroll type compressor according to claim 1 wherein the cooling chamber is a tubular cooling passage, the cooling passage and the gas cooler being placed one after the other in a radial direction.

4. The scroll type compressor according to claim 1 further comprising an auxiliary cooling chamber in the vicinity of the gas cooler wherein the cooling chamber and the auxiliary cooling chamber sandwich the gas cooler.

5. The scroll type compressor according to claim 1 wherein the gas cooler is formed integrally with the housing.

6. The scroll type compressor according to claim 1 wherein a dividing fin for dividing the gas flow is formed in the gas cooler.

7. The scroll type compressor according to the claim 6 wherein the dividing fin has the cooling chamber therein.

8. The scroll type compressor according to the claim 1 wherein a cooling fin is formed in the cooling chamber.

9. The scroll type compressor according to claim 1 wherein a bar for generating turbulence in the gas flow is formed in the gas cooler.

10. The scroll type compressor according to claim 1 wherein the gas is supplied to a fuel cell.

* * * * *